US011389715B1

(12) United States Patent
Giribaldo

(10) Patent No.: US 11,389,715 B1
(45) Date of Patent: Jul. 19, 2022

(54) TRAINING DEVICE FOR CUE SPORTS

(71) Applicant: Joe Giribaldo, Stamford, CT (US)

(72) Inventor: Joe Giribaldo, Stamford, CT (US)

( * ) Notice: Subject to any disclaimer, the term of this patent is extended or adjusted under 35 U.S.C. 154(b) by 0 days.

(21) Appl. No.: 17/175,767

(22) Filed: Feb. 15, 2021

Related U.S. Application Data

(63) Continuation-in-part of application No. 16/535,233, filed on Aug. 8, 2019, now Pat. No. 11,141,648.

(60) Provisional application No. 62/715,831, filed on Aug. 8, 2018.

(51) Int. Cl.
*A63D 15/00* (2006.01)

(52) U.S. Cl.
CPC ..... *A63D 15/006* (2013.01)

(58) Field of Classification Search
CPC ..... A63B 69/36; A63D 15/006; A63F 7/00
See application file for complete search history.

(56) References Cited

U.S. PATENT DOCUMENTS 3,033,570 A * 5/1962 Mathes ..... A63F 7/0017 273/120 R
4,268,033 A * 5/1981 Fontaine ..... A63D 15/006 473/2
4,469,328 A * 9/1984 Pacitti ..... A63D 15/005 473/40
5,376,054 A * 12/1994 Kwasny ..... A63D 15/005 473/40
5,997,404 A * 12/1999 Sardo ..... A63D 15/005 473/21
7,785,209 B1 * 8/2010 Targosz, Jr. ..... A63D 15/005 473/21
8,864,596 B1 * 10/2014 Maranian, Jr. ..... A63B 67/02 473/162
8,911,299 B1 * 12/2014 Day ..... A63D 15/005 473/40
9,539,492 B1 * 1/2017 Eager ..... A63D 15/006
9,616,319 B2 * 4/2017 Geiges ..... A63D 15/005
2005/0107176 A1 * 5/2005 Holt ..... A63D 15/006 473/2
2011/0201436 A1 * 8/2011 Robinson ..... A63D 15/10 473/42
2012/0302361 A1 * 11/2012 Kaplan ..... A63D 15/005 473/40

(Continued)

*Primary Examiner* — Eugene L Kim
*Assistant Examiner* — Christopher Glenn
(74) *Attorney, Agent, or Firm* — Patterson Intellectual Property Law, P.C.; Mark A. Kilgore

(57) ABSTRACT

A training device and method of use for positioning balls on the playing surface of cue sport game tables such as billiards is provided herein, to assist players in making practice shots to enhance their playing skills and techniques. The training device includes a central base and a pair of triangularly shaped ramps. The central base includes a rectangular bottom surface, first and second pentagonal side walls extending perpendicularly from the rectangular bottom surface. The pair of triangularly shaped ramps rotatably coupled to the central base on opposite sides of the first and second pentagonal side walls Each ramp includes first and second ramp edges extending acutely from a corner distal the central base. The pair of triangularly shaped ramps are configured to rotate about the central base between a first configuration associated with a first launch location and a second configuration associated with a second launch location.

17 Claims, 12 Drawing Sheets

(56) References Cited

U.S. PATENT DOCUMENTS

2018/0015356 A1* 1/2018 Lee ..... A63D 15/105

* cited by examiner

TRAINING DEVICE FOR CUE SPORTS

CROSS-REFERENCES TO RELATED APPLICATIONS

This application is a Continuation-in-Part application of U.S. Non-Provisional patent application Ser. No. 16/535,233, filed Aug. 6, 2019, entitled "Training Device for Cue Sports", which claims priority to U.S. Provisional Application No. 62/715,831, filed Aug. 8, 2018, entitled "Training Device for Cue Sports."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

1. Field of the Invention

The present invention relates to billiards, and more particularly, to a training device for positioning balls on the playing surface of cue sport game tables, such as billiards or pool, to assist players in making practice shots and further develop their playing skills and techniques.

2. Description of the Prior Art

Cue sports are generally played using a game table, balls, and an elongate cue stick that is generally held in a player's hands and maneuvered to forcibly strike the balls along the playing surface of the game table. The game table generally includes a rectangular geometric shape having a specific dimension, a smooth material top surface, and depending on the type of game played, a plurality of pockets situated at designated areas alongside the table for receiving balls during play. Exemplary depictions of cue sports include carom billiards, the well-known game of pool, and snooker which is similar to pool, but comprises a particular game table, and smaller balls. Each respective cue sport is governed by a set of rules and regulations of play defined by game instructions, historical use and culture, and various professional associations and organizations.

Both professional and amateur players alike often practice to further develop their playing skills at the game. One common practice drill entails making repeated cue shots to help improve the player's stance, coordination and shooting techniques over time. The practice drill generally involves positioning a host of object balls at predetermined positions on the playing surface of a cue sport game table, sequentially aligning a cue ball with each positioned object ball, and striking the cue ball forcibly with the distal end of a cue stick forcing the cue ball to collide with each target object ball, directing the object balls into table pockets. The training exercise permits players to strategically place object balls, and the cue ball, at various positions on the playing surface of the cue sport game table in an effort to strategize proper shooting angles, distances, stance, and requisite degree of impact force needed to improve their shooting skills. Individual players must consistently maneuver around the perimeter of the game table when setting up the object balls during a practice session. The need for positioning individual object balls at various locations on the game table is not only time consuming, but also interrupts the player's focus, mental concentration, and pre-shot routine analysis that is often undertaken during practice sessions.

A variety of conventional training devices have been designed in an effort to assist individual players in positioning billiard balls on the playing surface of cue sport game tables. For example, a prior art device includes a ramp having a mechanical clamp that is fastened along the perimeter of a game table where object balls are launched by hand onto the playing surface of the game table. Another prior art device includes a ramp that is placed on the surface of a game table, and is designed to readily hold a single ball at a time where players must apply a forward pushing force by hand on each ball in order to launch the balls down the ramp. Still other training devices include helical ramps, or employ electrical components such as electronic timers and solenoids that are electrically operated to release balls on the surface of a game table.

Conventional cue sport training devices are not without drawbacks. For example, the use of mechanical clamps results in attaching the device at one designated spot along the perimeter of the game table making it cumbersome and difficult to launch balls from different angles on the playing surface of the game table. Constantly loosening and tightening the mechanical clamp is time consuming, and cumbersome. Some prior art devices are specifically designed for use with object balls having a particular size thus restricting use to a particular game. Other training devices are bulky, awkward to use, and are not conveniently portable. Most conventional training aids require players to forcibly launch object balls down a ramp by hand. Those training devices typically provide a less effective means for accurately positioning balls on a playing surface of a table on a consistent basis. For example, as a result of disproportionate forces applied to object balls by a player's hand, it is very difficult to accurately position object balls in desired locations on a game table on a consistent basis. Often times players either drop the object balls onto the ramp with varying degrees of force, or provide a slight, unintentional forward force to the object balls when launching the balls by hand, thus forcing the object balls down the ramp with varying speeds. The forward force applied to object balls is generally proportional to the launching velocity such that a slightly stronger force will result in a faster rolling ball, and a lighter pushing force will result in an object ball rolling slower down a ramp. As a result of the differing forces applied to the object balls by the player's hand when launching object balls, the balls roll down prior device ramps at different velocities and thus into different positions on the game table leading to the inconsistent positioning of balls on the game table.

Accordingly, there is an established need for a training device that is easy to set-up, and use, accommodates use with balls of different sizes, includes a ball release system for selectively positioning balls on the playing surface of cue sport game tables in a controlled manner on a consistent basis, and is small, compact and portable for easily transporting the device to different locations for use with a variety of different cue sport game tables.

BRIEF SUMMARY

An embodiment of the present invention is directed to a training device for positioning balls on the playing surface of cue sport game tables such as billiards, to assist players in making practice shots. The training device includes a base, ramps pivotally attached to the base which are pivoted in a deployed position, and completely folded in a non-deployed position to provide portability, includes rails to accommodate cue balls of different sizes, and a ball release system including a loading pad and a ball stopper for sequentially deploying balls down the ramps in a controlled manner to accurately position balls on game tables on a consistent basis.

Another embodiment of the invention provides a training device for positioning balls on cue sport game tables. The training device comprises a central base and a pair of triangularly shaped ramps. The central base includes a rectangular bottom surface, first and second pentagonal side walls extending perpendicularly from the rectangular bottom surface, and a hole defined between the first and second pentagonal side walls. The pair of triangularly shaped ramps are rotatably coupled to the central base on opposite sides of the first and second pentagonal side walls. Each ramp of the pair of triangularly shaped ramps includes first and second ramp edges extending acutely from a respective corner distal the central base. The pair of triangularly shaped ramps in combination with the central base defines at least a first configuration associated with a first launch location and a second configuration associated with a second launch location, the second ramp edges of the pair of triangularly shaped ramps positioned parallel to the rectangular bottom surface of the central base in the first configuration, the first ramp edges of the pair of triangularly shaped ramps positioned parallel to the rectangular bottom surface of the central base in the second configuration.

In another aspect, the first and second ramp edges of each ramp of the pair of triangularly shaped ramps are equal in length.

In another aspect, each ramp of the pair of triangularly shaped ramps includes an arcuate edge extending between the first and second ramp edges opposite the respective corner.

In another aspect, at least a portion of the central base extends away from the pair of triangularly shaped ramps beyond the respective arcuate edges in the first configuration.

In another aspect, the pair of triangularly shaped ramps are pivotally coupled to the central base closer to the arcuate edge than to the respective corner of each ramp of the pair of triangularly shaped ramps using a fastener extending through the hole of the central base.

In another aspect, the first launch location is defined between the arcuate edges of each of the pair of triangularly shaped ramps and the central base in the first configuration.

In another aspect, the first launch location is defined in the first configuration and the second launch location is defined in the second configuration; and the first and second launch locations are configured to receive a ball prior to rolling the ball down the pair of triangularly shaped ramps.

In another aspect, the second ramp edges of the pair of triangularly shaped ramps each include a common length and a receiver channel defined perpendicularly to the common length; and the receiver channel of the second ramp edges of the pair of triangularly shaped ramps define the second launch location in the second configuration.

In another aspect, the receiver channel of each of the second ramp edges of the pair of triangularly shaped ramps are trapezoid shaped.

In another aspect, the pair of triangularly shaped ramps pivot around the central base between the first and second configurations.

In another aspect, each of the central base and the pair of triangularly shaped ramps includes an external non-slip covering.

In another aspect, the first pentagonal side wall is parallel to and spaced apart from the second pentagonal side wall.

In another aspect, the central base includes a first surface extending perpendicularly from the rectangular bottom surface between the first and second pentagonal side walls; the central base includes a second surface extending perpendicularly from the rectangular bottom surface opposite the first surface between the first and second pentagonal side walls; the central base includes a third surface extending from the first surface parallel to the rectangular bottom surface between the first and second pentagonal side walls; and the central base includes a fourth surface angularly extending between the second surface and the third surface and defined between the first and second pentagonal side walls.

In another aspect, each ramp of the pair of triangularly shaped ramps includes an arcuate edge defined between the first and second ramp edges, and a ramp hole positioned closer to the arcuate edge than to the respective corner; and the ramp hole of each ramp of the pair of triangularly shaped ramps is configured to align with the hole of the central base and receive a fastener for pivotally coupling the pair of triangularly shaped ramps to the central base.

In another aspect, each ramp of the pair of triangularly shaped ramps includes an elongated channel facing the central body defined circumferentially about the respective ramp hole; and each of the first and second pentagonal side walls of the central base includes an elongated protrusion defined circumferentially about the hole.

In another aspect, the elongated protrusion of the first pentagonal side wall is configured to engage the elongated channel of one ramp of the pair of triangularly shaped ramps; and the elongated protrusion of the second pentagonal side wall is configured to engage the elongated channel of a different ramp of the pair of triangularly shaped ramps.

In another aspect, the elongated protrusions of the first and second pentagonal side walls of the central base includes at least one movement limiting protrusion extending therefrom; the elongated channels of the pair of triangularly shaped ramps include at least one movement limiting protrusion positioned therein; and the at least one movement limiting protrusion of the elongated protrusion and the at least one movement limiting protrusion of the elongated channel are configured to selectively engage to limit movement between the first and second configurations.

Another embodiment of the invention is directed to a method of positioning balls on cue sport game tables using a training device. The method comprises (a) positioning a bottom surface of a central base of the training device on the cue sport game table; (b) rotating a pair of triangularly shaped ramps about the central base between a first configuration and a second configuration; (c) positioning a ball at one of a first launch location or a second launch location; and (d) launching the ball down the pair of triangularly shaped ramps.

In another aspect, step (d) of the method further comprises positioning a subsequent ball in its place at a same one of the first launch location or the second launch location.

These and other objects, features, and advantages of the present disclosure will become more readily apparent from the attached drawings and the detailed description of the preferred embodiments, which follow.

BRIEF DESCRIPTION OF THE SEVERAL VIEWS OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a training device for positioning balls on cue sport game tables. The training device includes a base, ramps pivotally attached to the base, a rail system provided on the base and ramps to accommodate balls of different sizes, and a ball release system that includes a loading pad operatively coupled to an articulating system including a first link, a second link, and a ball stopper, where the ball release system is operated to sequentially launch object balls down the ramps and into position on the playing surface of cue sport game tables in a controlled manner on a consistent basis.

Figure 1:
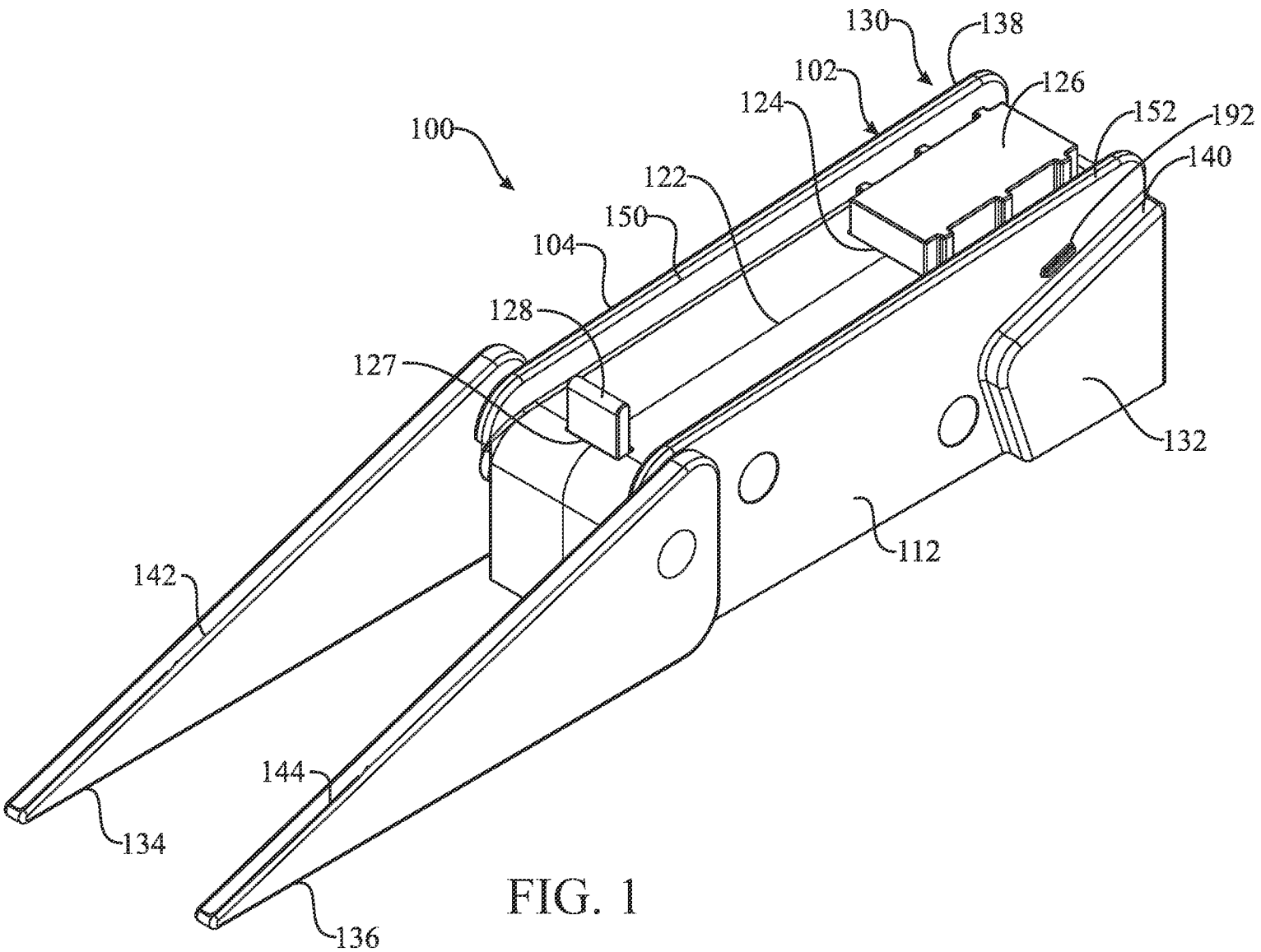
FIG. 1 presents a side perspective view of a training device for cue sports, showing a base including rails, ramps including rails and pivotally attached to the base for deploying object balls of different sizes on cue sport game tables, and a ball release system including a loading pad operatively coupled to a ball stopper for selectively positioning object balls in a controlled manner on game tables, in accordance with one embodiment of the present invention.
Figure 2:
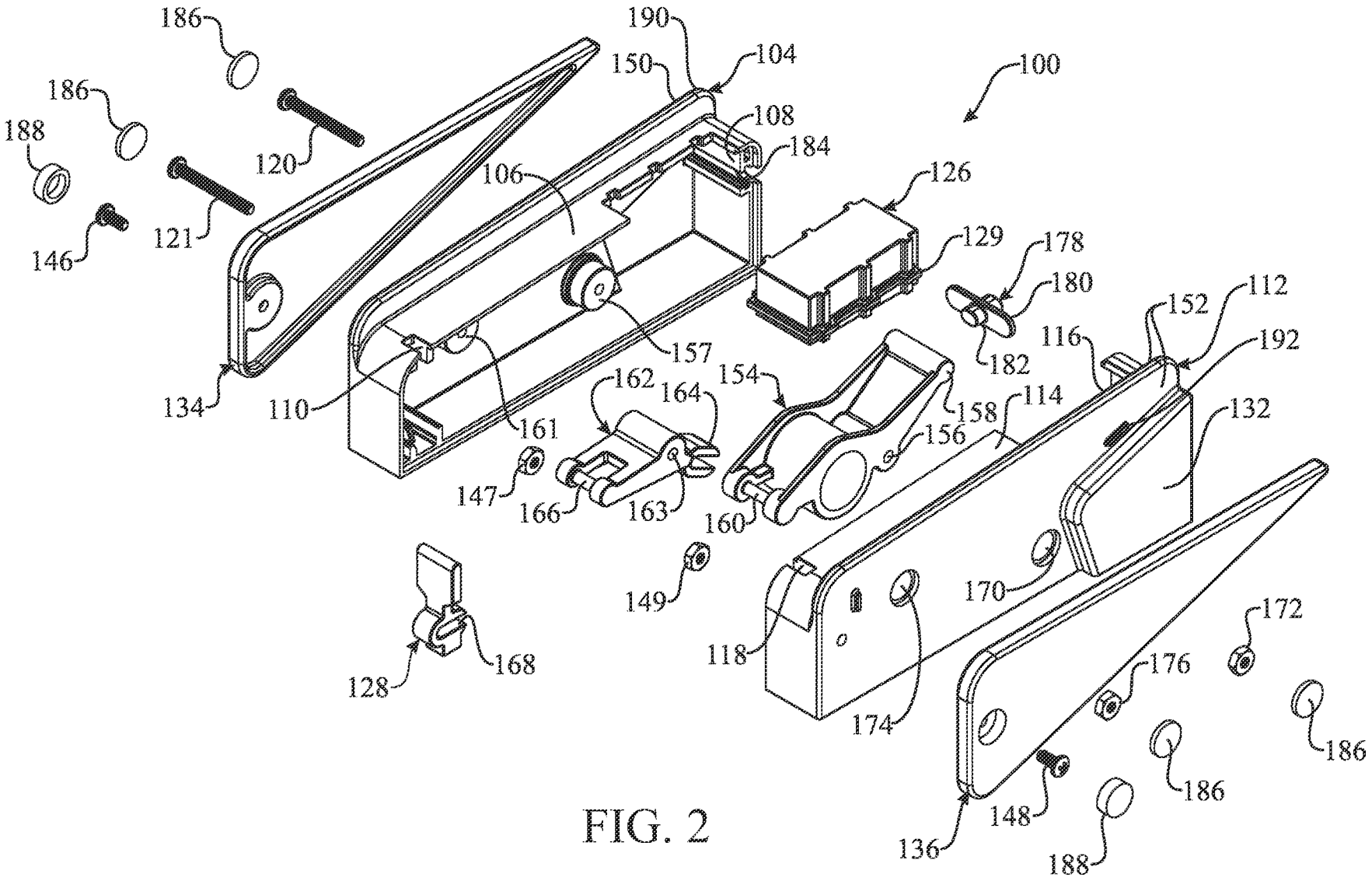
FIG. 2 presents an exploded view of the training device of FIG. 1, showing a plurality of functional parts including ramps, an articulating link system, and integral body parts of the base for readily assembling the training device.

Referring now to the drawings wherein like elements are represented by like numerals throughout, there is shown in FIGS. 1 and 2, a side perspective view, and an exploded view, respectively, of a training device 100 for strategically positioning object balls on the playing surface of cue sport game tables in a controlled manner on a consistent basis during practice shot sessions, via, a cue ball, in accordance with one embodiment of the present invention. Reference made herein to the term, "cue sports", includes, but is not limited to, the game of carom, billiards, pool, and snooker. Also, reference to the term, "object ball", includes one or more balls commonly known and used for playing billiards or pool that, during play, are impacted by force with a cue ball to move the one or more object balls along the playing surface of such game tables. The training device 100 includes a base 102 defined by a first body 104 including a ledge 106 and cut-outs 108 and 110 formed partially within the ledge 106, and a second body 112 including a ledge 114 and cut-outs 116, 118 also formed partially within the ledge 114. The first and second body 104, 112, respectively, are assembled together via, link fasteners 120, 121 such that the two ledges 106, 114 engage each other to form a top platform 122, and cut-outs 108, 110 engage cut-outs 116, 118, respectively, to form a loading pad opening 124 for receiving a vertically moving loading pad 126, and a stopper opening 127 for receiving a vertically moving ball stopper 128. Each body 104, 112 also includes a base stabilizer 130, 132 that is permanently or releasably secured to opposite outer surfaces of each body 104, 112 and hence the base 102, for securely supporting the base 102 on the playing surface of cue sport game tables. In a preferred embodiment, the base 102 comprises a generally rectangular geometric shape having a predetermined height, width, and length, and may comprise a solid body, a hollow body, or any combination thereof.

Each base stabilizer 130, 132 includes a first longitudinal edge integral with the top lateral edge 138, 140 that is integral with a second longitudinal edge. The second longitudinal edges are each longer in length, and opposite to, each first longitudinal edge. Preferably, each second longitudinal edge is coplanar with the back end of each body 104, 112, or back end of the base 102. The top lateral edge 138, 140 inclines upwards towards the back end of the base 102 at a predetermined angle and length. It is noted that the width of each top lateral edge 138, 140 is defined by the thickness of the material used to construct the base stabilizers 130 and 132. In a preferred embodiment, each top lateral edge 138, 140 spans a width that is equal to, or larger than, the width of each ramp rail 142, 144 of corresponding ramps 134, 136 as shown in FIG. 1. It is appreciated that the base stabilizers 130, 132 may comprise any geometric shape, size, or configuration.

Each body 104, 112 is preferably constructed as one integral part from any durable material, including but not limited to, a dense foam, a hard rubber, a hard polymer, wood, plastic, nylon, any lightweight metal such as aluminum, or any combination thereof, using any well-known process such as injection molding. In one embodiment, the base 102 may include one or more weights or a ballast that is enclosed within, or separately attached to, the body of the base 102 and/or one or both stabilizers 130, 132 to help weight down and secure the cue sport training device 100 in position when disposed on the playing surface of a cue sport game table. The added weight may include a single or multiple pieces of any of metal, lead, ceramic, wood, or include a ballast such as sand or pebbles. For example, small metal plates may be attached to, or encased within, each stabilizer 130, 132, or base 102 to provide added weight.

With continued reference made to FIGS. 1 and 2, the training device 100 includes a pair of ramps 134, 136 each pivotally attached to opposite sides of the base 102 via, ramp fasteners 146 and 148. Each ramp 134, 136 includes a fastener opening for inserting the ramp fasteners 146, 148 through to pivotally attach the ramps 134, 136 to the sides of the base 102 via, nuts 147 and 149, as illustrated in FIG. 2. In one non-limiting embodiment, ramp fasteners 146, 148 may include screws, a threaded bolt and nut, or a lateral pin or rod that rotatably extends through designated fastener openings formed through the body of each ramp 134, 136, and the base 102. For example, a lateral rod or pin can be firmly retained in place by compressing the opposite ends of the pin or rod, or by use of a mechanical member to prevent the elongate pin or rod from sliding out through formed holes. Alternatively, the articulated, pivoted action of the ramps 134, 136 may be accomplished by a hinge assembly, a tooth gear system, or other suitable articulating or mechanical components. It is contemplated that in one embodiment, ramps 134, 136 move together in parallel, as a single unit. Thus, specific fasteners can be employed to interlock with, or permanently attach to, each ramp 134, 136 to prevent the ramps 134, 136 from pivoting independently from one another about the base 102. One example of such specific fastener may include a bridging element (not shown) such as a webbing or bar that is placed across the ramps 134, 136, at a location that does not restrict object balls from rolling down the ramps 134, and 136. Although a preferred embodiment depicts ramps 134, 136 as being pivotally attached to the base 102, it will be understood that ramps 134, 136 can be releasably attached to opposite sides of base 102, using releasable fasteners such as magnets, hook and loop, snaps, clips, or an interlocking configuration. Thus, the training device 100 includes ramps 134, 136 that are either permanently, or removably, attached to opposite sides of the base 102 using a variety of different connectors or fasteners.

In one non-limiting embodiment, each ramp 134, 136 generally comprises a triangular geometric shape defined by a lateral leg integrally formed with a longitudinal leg, and a hypotenuse that extends from the distal end of the lateral leg to the distal end of the longitudinal leg. In one embodiment, the hypotenuse of each ramp member 134, 136 defines a pair of ramp rails 142, 144 having a top, planar surface comprising a predetermined width that is designed to engage the top lateral edges 138, 140 of each base stabilizer 130, 132, when the ramps 134, 136 are folded, in a non-deployed position, as better illustrated in FIG. 6. The dimensional characteristic of each ramp 134, 136 is selected to permit object balls to roll down the ramp rails 142, 144 by gravity, at a given velocity governed by the angle of each hypotenuse of ramps 134 and 136. It is contemplated that in order to help reduce weight, unwanted material can be removed from the body of each ramp 134, 136 forming openings, gaps, or grooves through the body of each ramp 134, and 136, if desired.

The training device 100 is designed for use with a variety of different cue sport games and includes a rail system for accommodating object balls of different sizes. The rail system includes a pair of ramp rails 142, 144 defined by the hypotenuse of each ramp 134, 136, and a pair of base rails 150, 152 that each extend upwards from opposite lateral edges of the base 102 in parallel with each other. As such, as shown in FIGS. 1 and 2, each ramp rail 142, 144 is integrally formed with respective bodies of each ramp 134, 136, and rails 150, 152 are integrally formed with each first and second body 104, 112 of the base 102. In one non-limiting embodiment, each rail 142, 144, 150, 152 may comprise a flat, planar top, a rounded top edge, or an elongate bar or rod having a predetermined diameter. In one embodiment, each ramp rail 142, 144, and each base rail 150, 152 may include a top, planar edge having a predetermined width that is preselected to accommodate objects balls of different sizes. For example, rails 142, 144, 150, 152 may include a top, planar edge in which the width of the edge is larger to reduce parallel spacing between the rails 142, 144, and 150, 152 for accommodating object balls having smaller diameters, or, alternatively, the width of each top, planar edge of each rail 142, 144, and 150, 152 may be smaller to increase the parallel spacing between the rails 142, 144, and 150, 152 to accommodate object balls having larger diameters. Thus, the training device 100 may be engineered and constructed for use with objects balls of different sizes. In one embodiment, rails 142, 144, 150, 152 may include an adjustable mechanism that permits users to adjust the parallel spacing between the rails 142, 144, 150, 152 to adjust parallel spacing and accommodate use with object balls of different sizes. In one embodiment, a friction material may be coated on, or separately attached to, the top outer surface of each rail 142, 144, 150, 152 to reduce or increase rotational frictional of object balls when rolling on the rails 142, 144, 150, and 152. Such frictional material may include rubber, silicone, lubrication, plastic film, anti-friction coating, anti-friction paint, smooth surface finish, rough surface finish, urethane, epoxy, enamels, or any combination.

Figure 3:
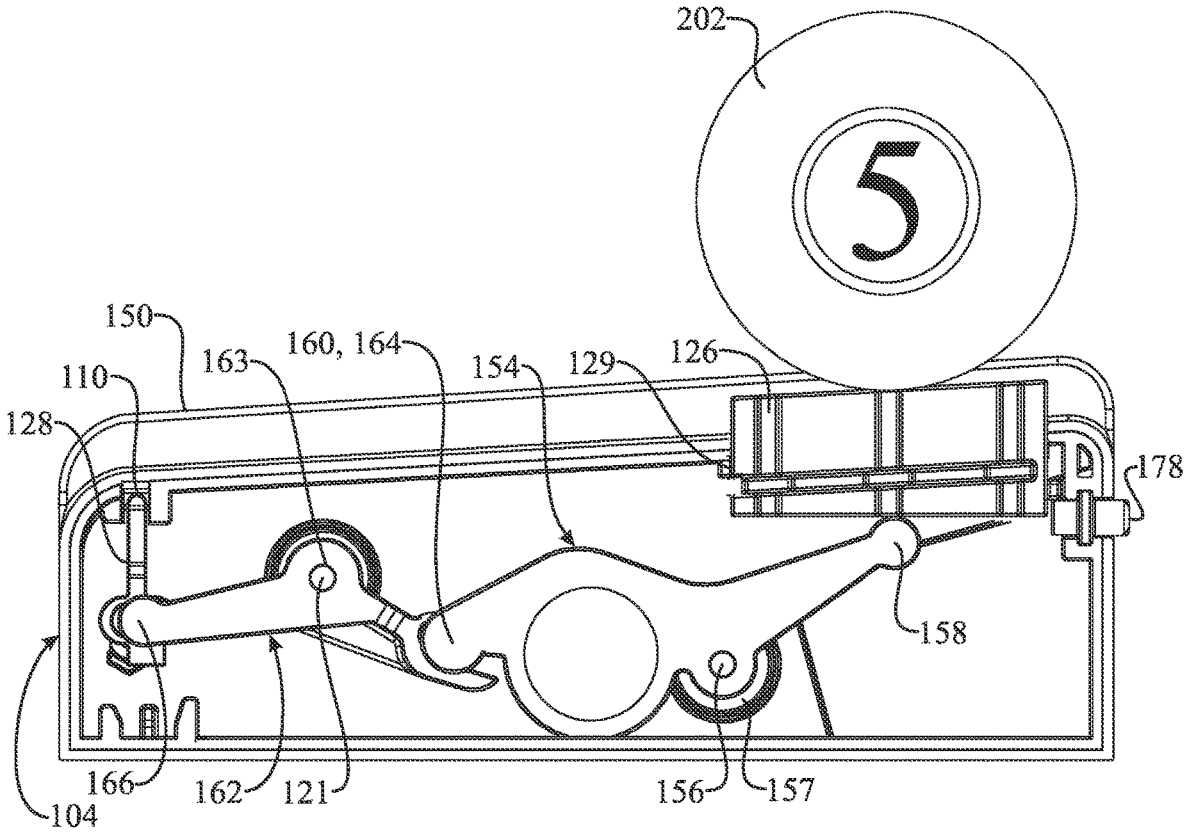
FIG. 3 presents a side perspective view of the training device of FIG. 1 with a second body of the base removed, showing the ball release system including a loading pad, a lock, an articulating link system including a first link mechanically coupled to a second link, and a ball stopper coupled to the distal end of the second link for controllably launching object balls down the ramps.

Turning now to FIGS. 2 and 3, the training device 100 employs a ball release system for providing a controlled method of launching object balls, and assuring accurate and consistent positioning of the object balls on the playing surface of a cue sport game tables during practice. Prior art devices generally require players to apply a forward pushing force by hand to propel object balls down a ramp and onto the top playing surface of game table. As a result of a disproportionate amount of force applied by the player's hand, the object balls roll in different positions on the game table. The applied force is generally proportional to the rolling velocity imparted on the object ball, thus, a faster moving ball will come to rest at a different position on the game table as will a slower moving ball. As such, the present invention assures the accurate placement and positioning of object balls on a game table by implementing the use of a ball release system which eliminates the need of applying a pushing force to launch object balls.

The ball release system includes a first link 154 having a hole 156, an upwardly extending arm 158, and a link post 160, a second link 162 having a hole 163, a link groove 164 and a second link post 166, and a ball stopper 128 including a stopper groove 168. In assembly, the two links 154, 162 attach together such that the link groove 164 of the second link 162 receives the link post 160 of the first link 154, and the stopper groove 168 of the ball stopper 128 receives the second link post 166 of the second link 162. The parts are assembled together and enclosed within the base 102 so that a link fastener 120 extends through the hub 158, through the hole 156 of the first link 154 and through a fastener opening 170 provided in the second body 112. A fastener nut 172 is employed to secure the two bodies 104, 112 together, as better illustrated in FIG. 2. Another link fastener 121 extends through another hub 161, a hole 163 provided in the body of the second link 162, and through a fastener opening 174 provided in the second body 112. A fastener nut 176 secures the two bodies 104, 112 together. As the links 154, 162 are mechanically coupled together within the body of the base 102, the ball stopper 128 is aligned with the ball stopper opening 127 formed by the cut-outs 110 and 118 depicted in FIG. 2, and controllably moves along the vertical axis within the opening 127. It will be understood that the parts comprising the first link 154, the second link 162, the ball stopper 128 and the loading pad 126 may each be constructed from a durable, lightweight material comprising plastic, nylon, or a light metal material.

The loading pad 126 comprises a generally square or rectangular member that includes a peripheral lip 129 for engaging the surrounding perimeter of the loading pad opening 124 when the training device 100 is assembled to prevent the loading pad 126 from exiting the load pad opening 124, as shown in FIG. 3. A friction material or coating may be applied to the upper surface of the loading pad 126 to provide frictional engagement with the surface of an object ball when disposed on the loading pad 126 during use. Such frictional material may include rubber, silicone, dimples, ridges, or grooves. It is appreciated that either the top surface of the loading pad 126, or the base rails 150, 152 may slope slightly downwards towards the front end of the base 102, at a predetermined angle, to direct object balls in a forward direction towards the ball stopper 128 during use.

With continued reference to FIG. 3, a lock 178 is provided at the back end of the base 102 and operated to prevent the loading pad 126 from moving vertically within the loading pad opening 124. In one embodiment, the lock 178 includes a slider 180 having a nub or protrusion 182 extending outwards from the slider 180. The slider 180 slides between slider rails 184 provided on the inner surface of the first and second body 104 and 112, as shown in FIG. 2. The nub 182 may be operated to engage with the peripheral lip 129 of the loading pad 126 or the pad 126 may include a short extension that engages the lock 178. In the present embodiment, the lock 178 slides from left to right to engage and disengage the protrusion 182 with the loading pad 126 to selectively prevent the loading pad 126 from moving vertically. It will be appreciated that other mechanical arrangements may be implemented to provide a lock 178 for selectively preventing the loading pad 126 from moving vertically within the loading pad opening 124 including for example, a push-pull button, a swing lever, or spring detent mechanism.

Upon complete assembly of the parts outlined in FIG. 3, the first body 104 is securely fastened to the second body 112 with link fasteners 120 and 121, and respective fastener nuts 172, 176. As shown in FIG. 3, each fastener opening 170, 174, and fastener openings provided in the ramps 134, 136, include a counter bore to permit the heads of the link fasteners 120, 121, ramp fasteners 146, 148, fastener nuts 172, 176 to enter the counter bore. A series of covers 186, 188 are employed to cover the link fasteners 120, 121, ramp fasteners 146, 148 and nuts 172, 176 to promote the cosmetic appearance of the training device 100. The covers 186, 188 may generally comprise plastic, wood, or metal covers that correspond to the same or different color or pattern of the base 102.

Figure 4:
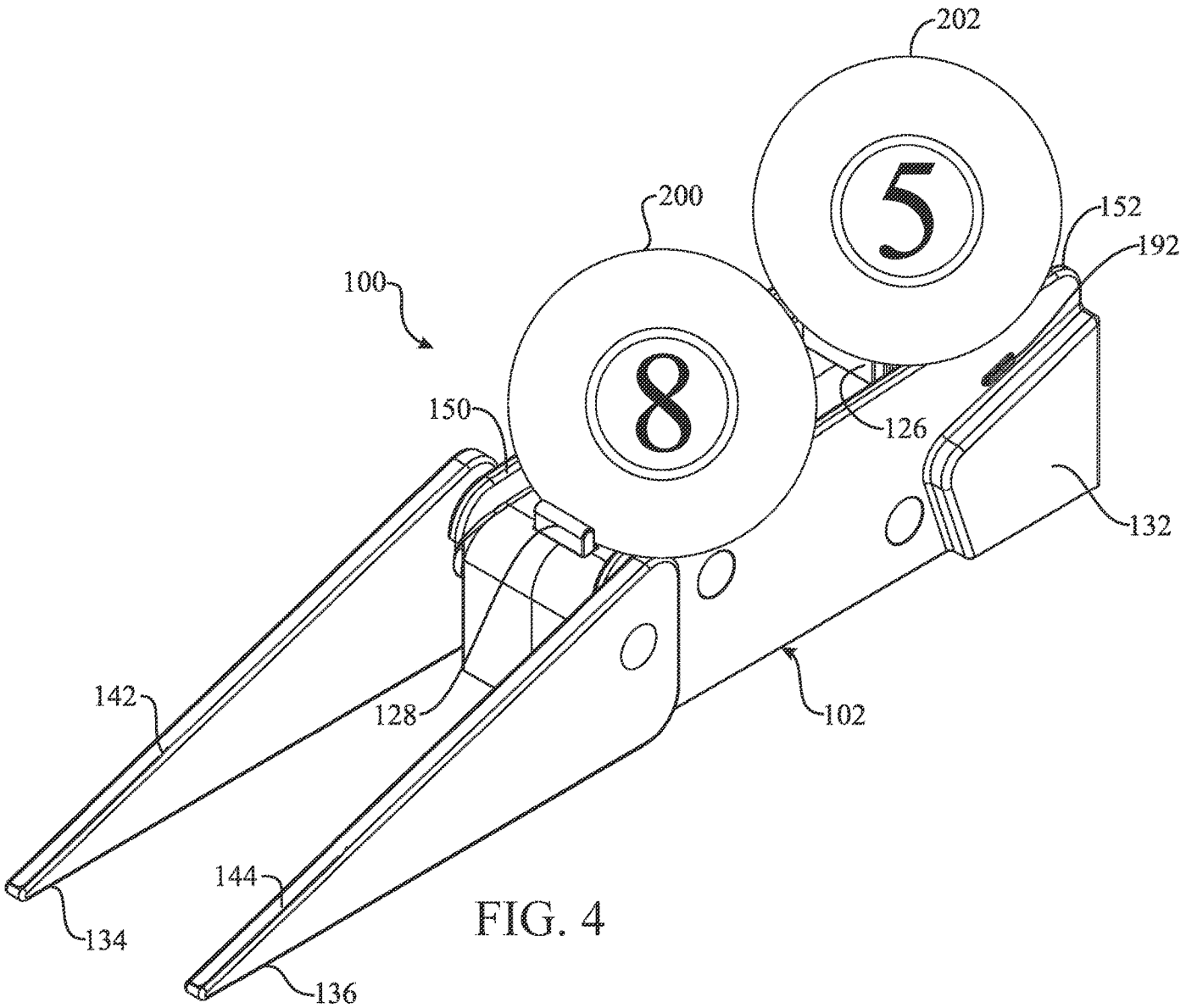
FIG. 4 is a side perspective view of the training device of FIG. 1, showing one object ball resting against the ball stopper for ready deployment down the ramps, and a second object ball readily disposed on the loading pad of the ball release system to lower the ball stopper and launch the one object ball down the ramps by gravity.
Figure 5:
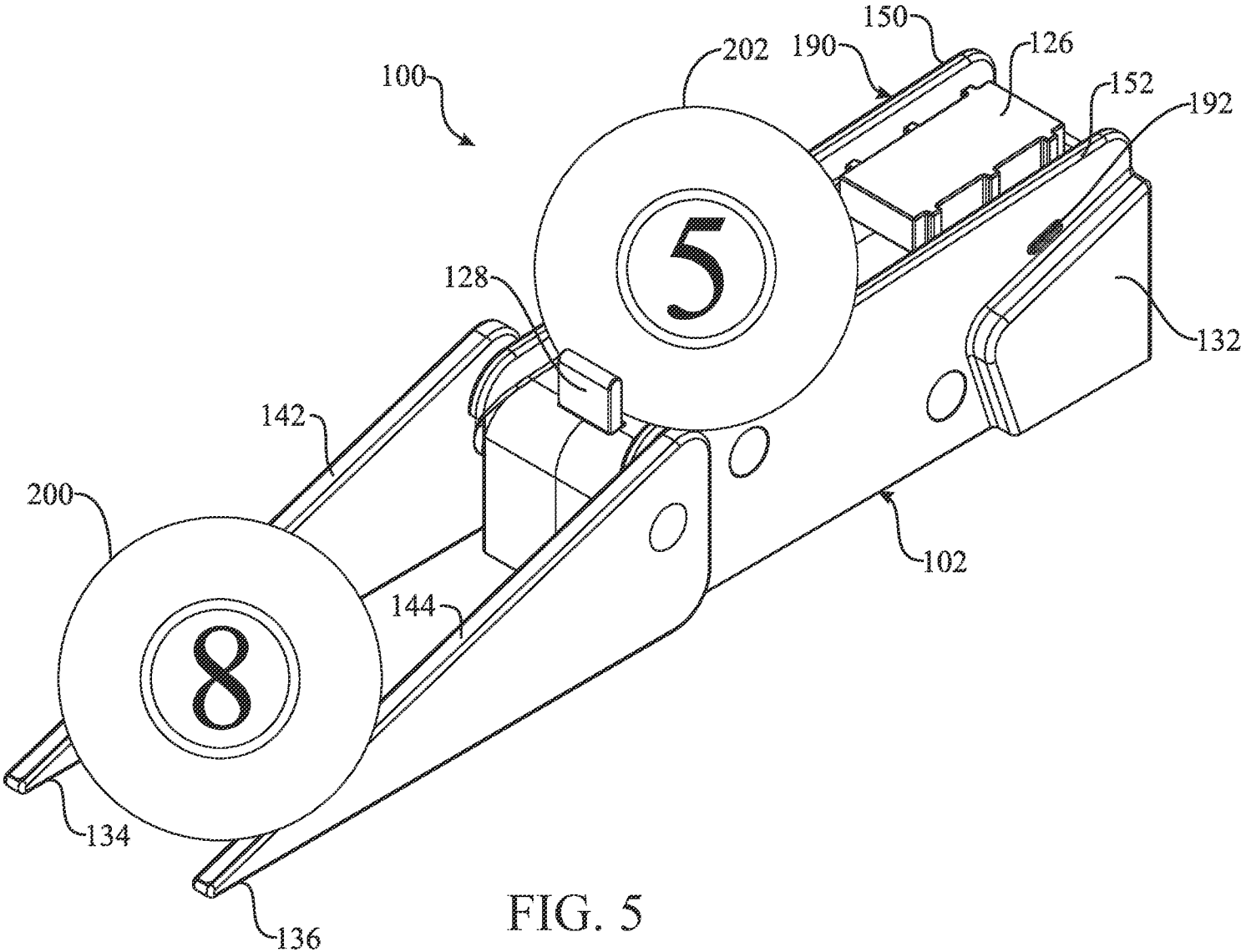
FIG. 5 is a side perspective view of the training device of FIG. 4, showing the one object ball rolling down the ramps in ready position on a cue sport game table, while the second object ball rolls off the loading pad along the base rails and butts against the ball stopper.

Ready deployment of an object ball 200 onto the playing surface of a cue sport game table is better illustrated in reference to FIGS. 2, 4, and 5. With the lock 178 poised in an unlocked position, an object ball 200 is initially positioned on the base rails 150, 152 of the base 102 directly behind the ball stopper 128. In the illustrative embodiment of FIGS. 4 and 5, the object ball 200 is identified as the number 8 ball associated with a ball in the game of pool. Another object ball 202, denoted as the number 5 ball, is disposed on the loading pad 126 of the ball release system. As shown in FIG. 3, the weight of the object ball 202 forces the loading pad 126 to move vertically downwards which forces the upwardly extending arm 158 of the first link 154 downwards thus rotating the first link 154 about the link fastener 120 in the opening 156 and moving the link post 160 upwards. As the link post 160 moves upwards, the second link 162 rotates about the link fastener 121 extending through the opening 163 forcing the link post 166 downwards thus moving the ball stopper 126 downwards through the ball stopper opening 127 along a vertical axis, as shown in FIG. 4. Once the ball stopper 126 is completely retracted within the ball stopper opening 127 of the base 102, the barrier preventing the object ball 200 down the ramps 134, 136 is removed, and the object ball 200 is launched down the ramps 134, 136 and rolls along ramp rails 142, 144, as shown in FIG. 5. The second object ball 202 begins to roll in a forward direction off the loading pad 126 towards the front end of the base 102 along base rails 150, 152 where the downward weight of an object ball 202 is removed from the loading pad 126 resulting in the upwardly extending arm 158 moving upwards rotating the first link 154 in an opposite direction and forcing the link post 160 downwards while rotating the second link 162 where the link post 166 begins to move upwards forcing the ball stopper 128 upwards through the ball stopper opening 127 along a vertical axis to extend upwards from the top platform 122 blocking and preventing the object ball 202 from rolling down ramps 134, and 136. As such, as the object ball 202 rolls off the loading platform 126, the ball stopper 128 is uplifted to prevent the object ball 202 from transitioning down the ramps 134, and 136. When ready, the player disposed another object ball on the loading pad 126, forcing the ball stopper 128 downwards allowing the object ball 202 to roll down the ramps 134, 136 coming to rest in position on the surface of the cue sport game table. The sequence of steps is repeated to sequentially position a plurality of object balls on the playing surface of a game table during a practice session. In circumstances where players do not wish to launch or position an object ball, the player can simply slide the lock 178 into a locking position to prevent the loading pad 126 from moving vertically downwards and articulating the links 154 and 162 to move the ball stopper 128.

Figure 6:
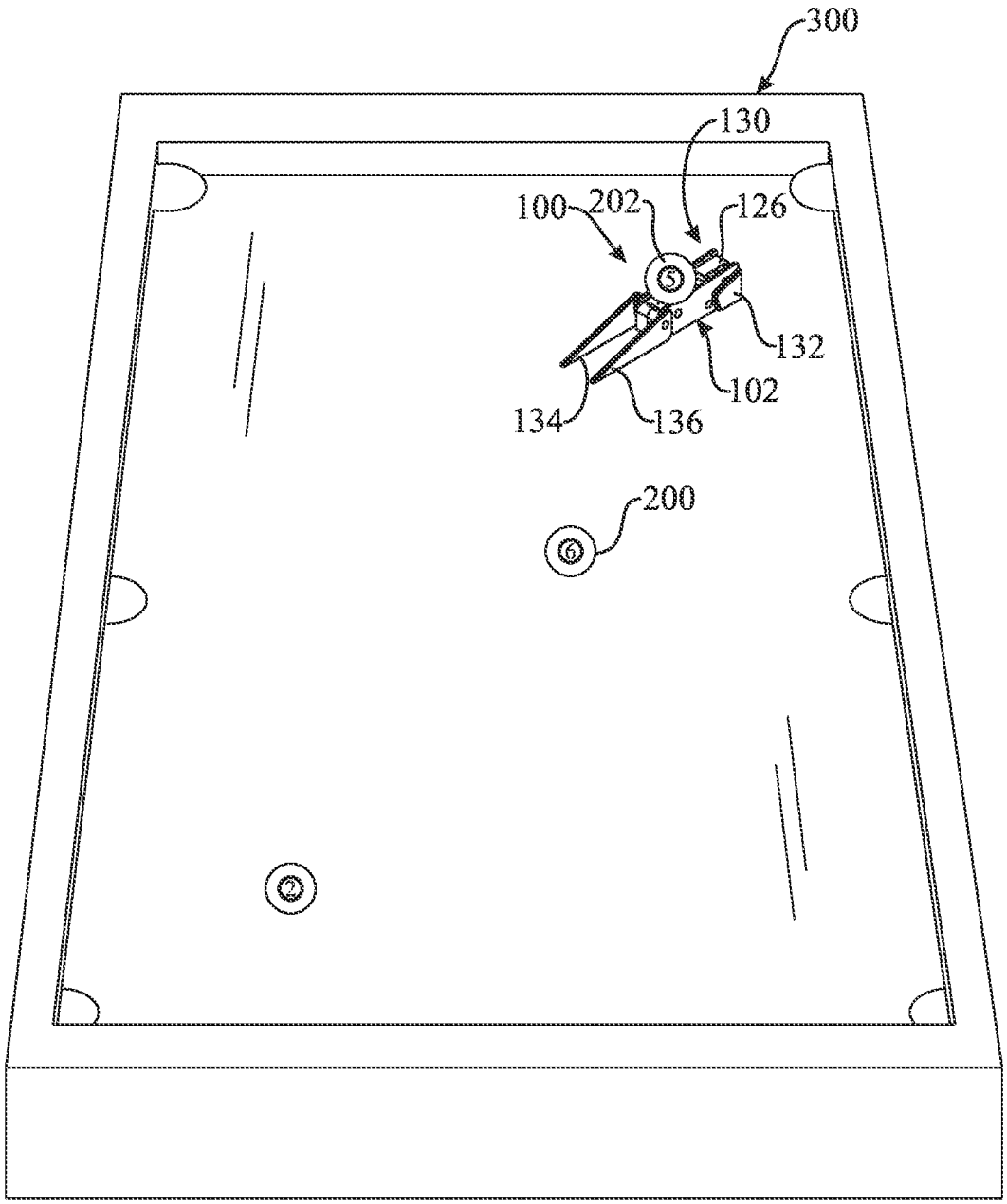
FIG. 6 is a perspective view of the training device of FIG. 1 disposed on the playing surface of cue sport game table, showing object balls deployed in various positions on the cue sport game table in preparation for a practice shot via, a cue ball, and a second object ball poised against the ball stopper for readily rolling down the ramps.

Turning now to FIG. 6 there is shown, a top perspective view of the training device 100 disposed on the playing surface of a cue sport game table 300, with one object ball 202 located on base rails 150, 152 behind the ball stopper 128 for readily launching the ball in position on the game table 300 in preparation for making practice shots, in accordance with one embodiment of the present invention. The training device 100 is employed by individual players during practice sessions to improve their skills and techniques of playing cue sports. During a practice session, the player disposes the training device 100 on the upper playing surface of a cue sport game table 300. In doing so, the base stabilizers 130, 132 provide added stability to properly balance and retain the training device 100 in position. As described with reference to FIGS. 2, 4, and 5, an initial object ball 200 is disposed on the base rails 150, 152, of the base 102, behind the ball stopper 128. Players point the distal ends of the ramps 134, 136 towards the general direction of interest for situating the object ball 200 in position on the table 300. To deploy the object ball 200 down the ramps 134, 136 and into position on the table 300, players dispose a second object ball 202 onto the loading pad 126, as was illustrated in FIGS. 4 and 5. The weight of the object ball 202 forces the loading pad 126 to move downwards forcing the ball stopper 128 vertically downwards allowing the object ball 200 to roll down the ramps 134, 136 by gravity, and into position on the top playing surface of the game table 300, as shown in FIG. 6. As the object ball 200 rolls off the loading pad 126 over base rails 150, 152, the weight of the object ball 200 is removed from the loading pad 126 allowing the ball stopper 128 to move vertically upwards to prevent the previously loaded object ball 202 from rolling down ramps 134, 136, via the ball stopper 128. Players can quickly and easily position the training device 100 at different angles on the table 300, and repeat the sequence of disposing object balls, one at a time, onto the loading pad 126 for positioning balls at different locations on the game table 300 during practice sessions. During practice, players strategically align a cue ball with each object ball positioned placed on the table 300 to make repetitive practice shots while enhancing their playing skills. The simplified construction of the training device 100 includes a ball release system that provides an effective tool for selectively launching object balls down the ramp rails 142, 144 of ramps 134, 136 in a controlled manner to accurately position the object balls on a cue sport game table 300 on a consistent basis during practice sessions, thus eliminating the need for players to apply a pushing force to launch balls down a ramp by hand.

Figure 7:
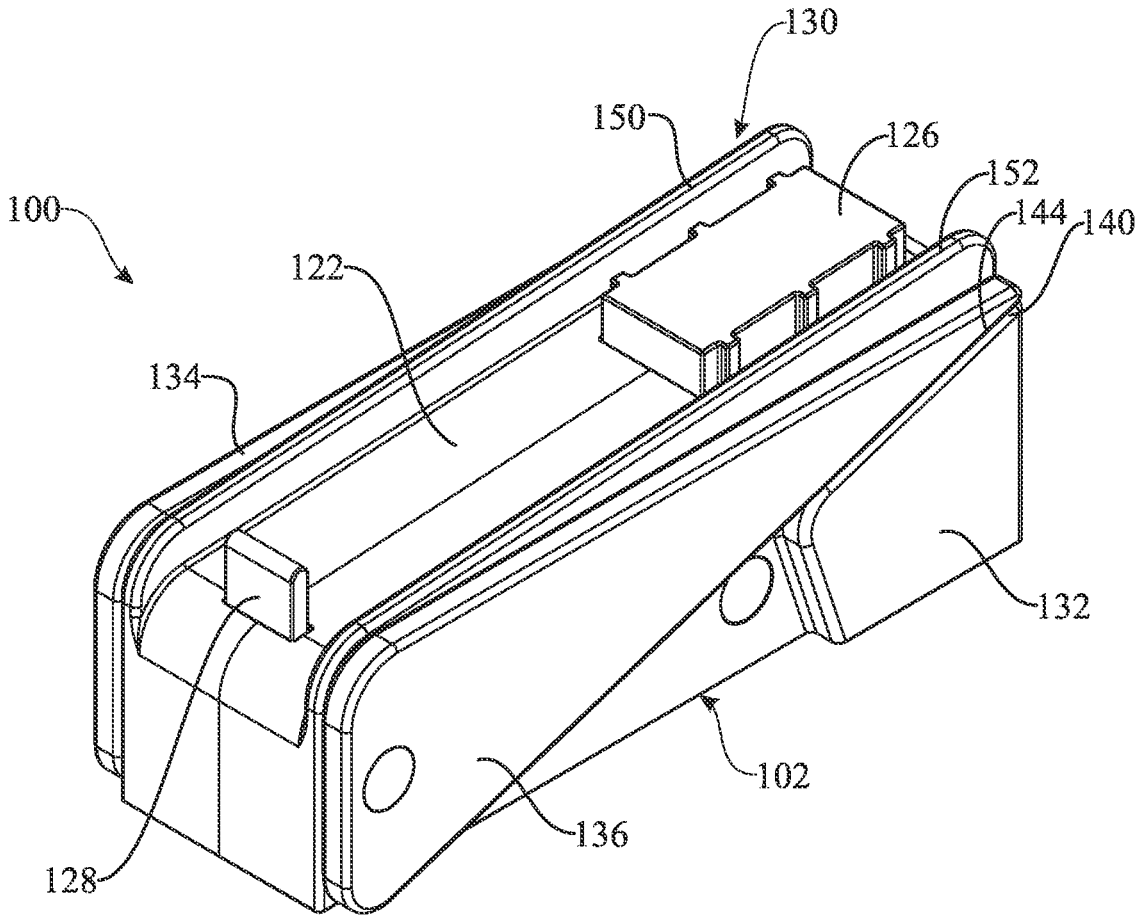
FIG. 7 is a side perspective view of the training device FIG. 1, showing the ramps in a folded, non-deployed position resting on top lateral edges of corresponding base stabilizers for easily transporting and storing the training device.
Figure 8:
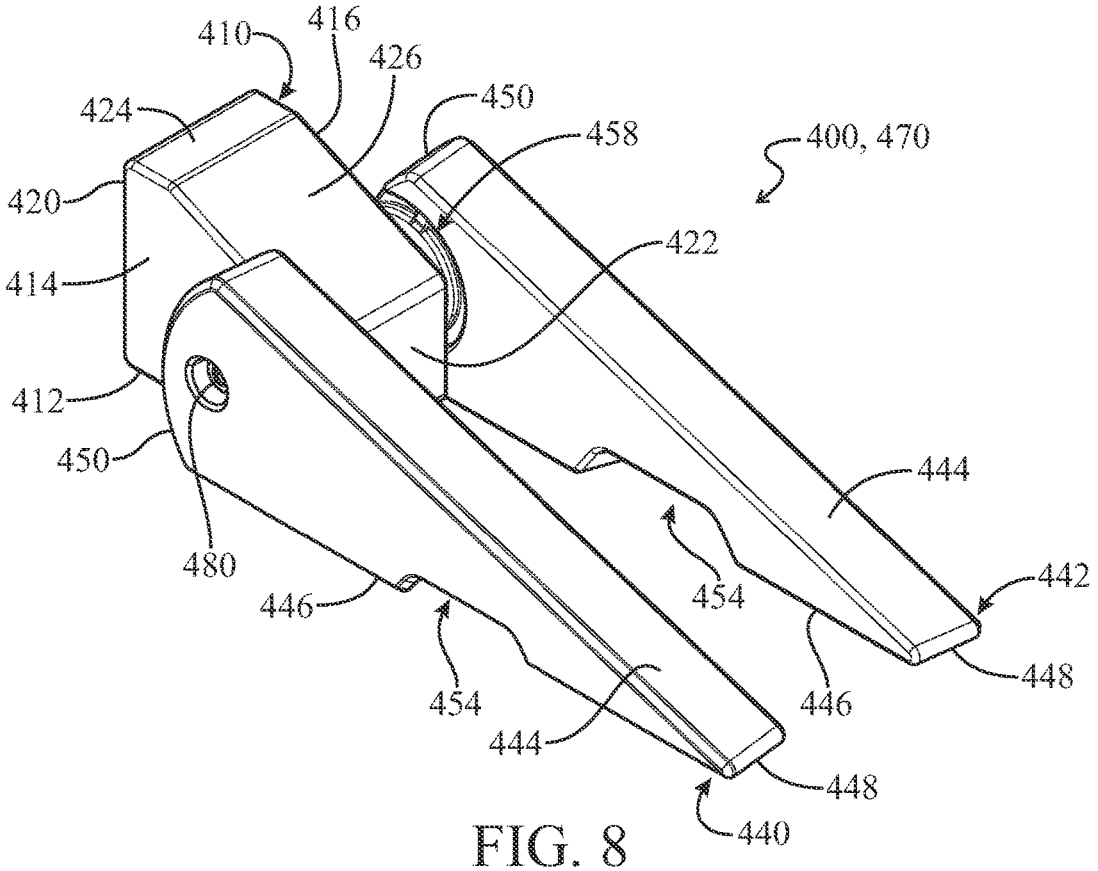
FIG. 8 is a perspective view of a training device in a first configuration in accordance with another embodiment of the present disclosure.
Figure 9:
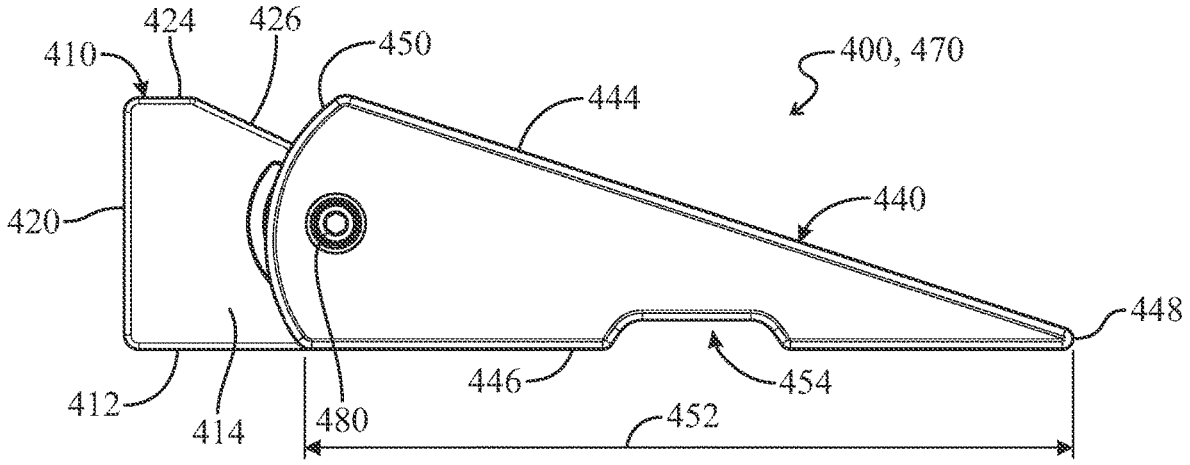
FIG. 9 is a side elevation view of the training device of FIG. 8 in the first configuration in accordance with the present disclosure.

Referring now to FIG. 7, there is shown a perspective view of the training device of FIG. 1, showing ramps 134, 136 completely folded about the base 102 in a non-deployed position to provide a portable training device 100 that is easily stored in one's pocket, carried and transported for use at different locations or establishments. In one non-limiting embodiment, a pair of detents 190, 192 such as outwardly extending ridges, are provided on opposite sides of the base 102 and oriented slightly above each base stabilizer 130 and 132. Each detent 190, 192 is designed to engage with and securely retain the ramps 134, 136 in a fully folded, pivoted position such that the top, planar rail 142, 144 of each ramp 134, 136, respectively, engages the top lateral edges 138, 140 of each base stabilizer 130, and 132. The inclined surface of the top lateral edges 138, 140 corresponds to a portion of respective hypotenuse of each ramp 134, 136 providing for smooth engagement of the ramps 134, 136 with respective base stabilizers 130, 132. When the ramps 134, 136 are fully folded and pivoted in a closed, non-deployed position, the training device 100 assumes a generally, rectangular shape to more easily store the training device in a player's pocket. It will be understood that detents 190, 192 may comprise rounded members shaped as a semi-sphere, generally constructed from a plastic or smooth nylon material, or include a spring or bias member for providing spring-detents that resiliently extend outwards, away from the base 102. Each detent 190, 192 may correspondingly engage with, and releasably extend within, detent holds formed at designated areas within the inner surface of each ramp 134 and 136. In one non-limiting embodiment, the detent holds may each comprise a hole, or bore, ridge, groove, protrusion, catch, or indentation provided at predetermined locations within the inner surface of ramp members 134, and 136. It will be appreciated that additional detents may also be employed to releasably lock the ramps 134, 136 in place, in a fully open, deployed position.

The cue sport training device 100 is designed for use with a host of different cue sport games including carom, pool, billiards, or snooker, and is easy to use when positioning object balls at various locations on the playing surface of game tables to assist players in making repetitive practice shots without hindering the positional stance, concentration level, and coordination undertaken during practice sessions. The ramps 134, 136 are pivoted about the base 102 into a fully deployed position where the ramps 134, 136 extend forwards in front of the ball stopper 128, or are fully folded about the base 102 to rest on base stabilizers 130, 132 when in a non-deployed position to provide portability. The cue sport training device 100 may include any color, pattern, design, logo, advertisement, or indicia.

Referring to FIGS. 8-14, an embodiment of a training device 400 for positioning balls 200, 202 on a cue sports game table 300 is shown. The training device 400 features two launch locations (e.g., a near shot location and a long shot location) from which a ball may be manually launched, for example, by positioning a subsequent ball in the place of the ball to be launched. The training device 400 comprises a central base 410 and a pair of triangularly shaped ramps 440, 442 rotatably coupled to the central base 410.

The central base 410 includes a rectangular bottom surface 412, first and second pentagonal side walls 414, 416, and a hole 418 defined between the first and second pentagonal side walls 414, 416. The first and second pentagonal side walls 414, 416 extend perpendicularly from the rectangular bottom surface 412. The first pentagonal side wall 414 is parallel to and spaced apart from the second pentagonal side wall 416.

The central base 410 further includes a first surface 420, a second surface 422, a third surface 424, and a fourth surface 426. The first, second, third, and fourth 420, 422, 424, 426, as well as the rectangular bottom surface 412 all extend between the first and second pentagonal side walls 414, 416. The first surface 420 extends perpendicularly from the rectangular bottom portion 412. The second surface 422 extends perpendicularly from the rectangular bottom portion 412 opposite the first surface 420. The second surface 422 is shorter, perpendicular from the rectangular bottom surface 412, than the first surface 420. The third surface 424 extends from the first surface 420 parallel to the rectangular bottom surface 412. The fourth surface 426 angularly extends between second surface 422 and the third surface 424.

The pair of triangularly shaped ramps 440,442 are rotatably coupled to the central base 410 on opposite sides of the first and second pentagonal side walls 414, 416. Each ramp of the pair of triangularly shaped ramps 440, 442 may include a first ramp edge 444 and a second ramp edge 446 extending acutely from a respective corner 448 of the ramp distal the central base 410. The first and second ramp edges 444, 446 may also be referred to herein as first and second ramped edges 444, 446. In other words, the first and second ramp edges 444, 446 of each of the pair of triangularly shaped ramps 440, 442 are coupled together at the corner 448. Each ramp of the pair of triangularly shaped ramps 440, 442 may further include an arcuate edge 450 extending between first and second ramp edges 444, 446 distal the corner 448. The first and second ramp edges 444, 446 of each of the pair of triangularly shaped ramps 440, 442 may be equal in length.

Figure 10:
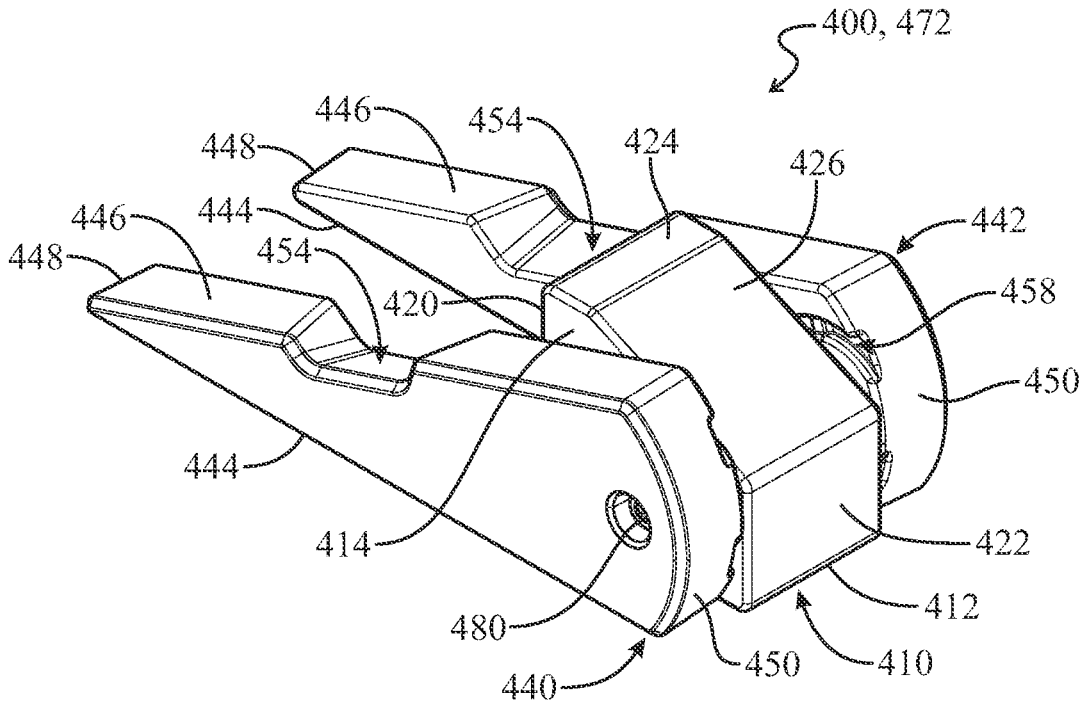
FIG. 10 is a perspective view of the training device of FIG. 8 in a second configuration in accordance with the present disclosure.
Figure 11:
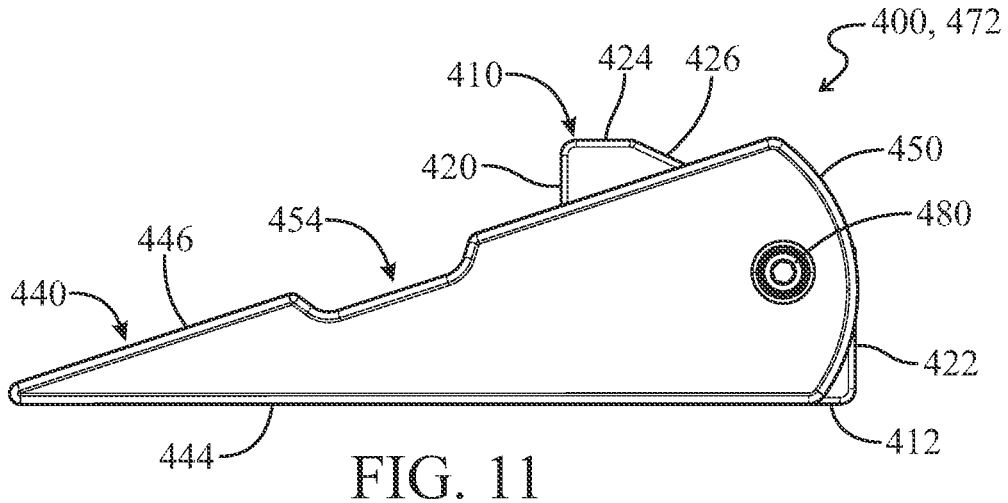
FIG. 11 is a side elevation view of the training device of FIG. 8 in the second configuration in accordance with the present disclosure.
Figure 13:
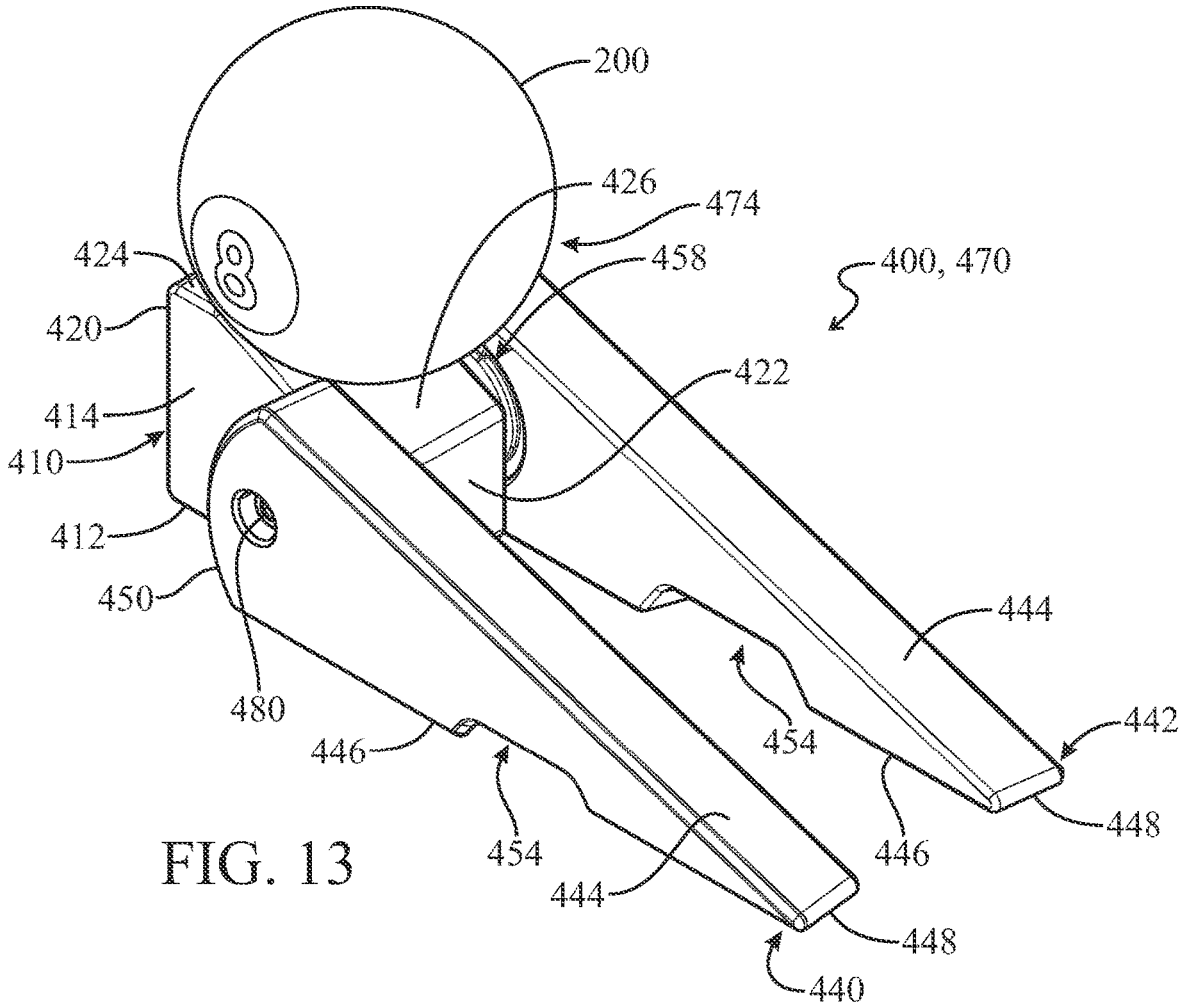
FIG. 13 is a perspective view of the training device of FIG. 8 in the first configuration with an object ball positioned in a first launch location in accordance with the present disclosure.
Figure 14:
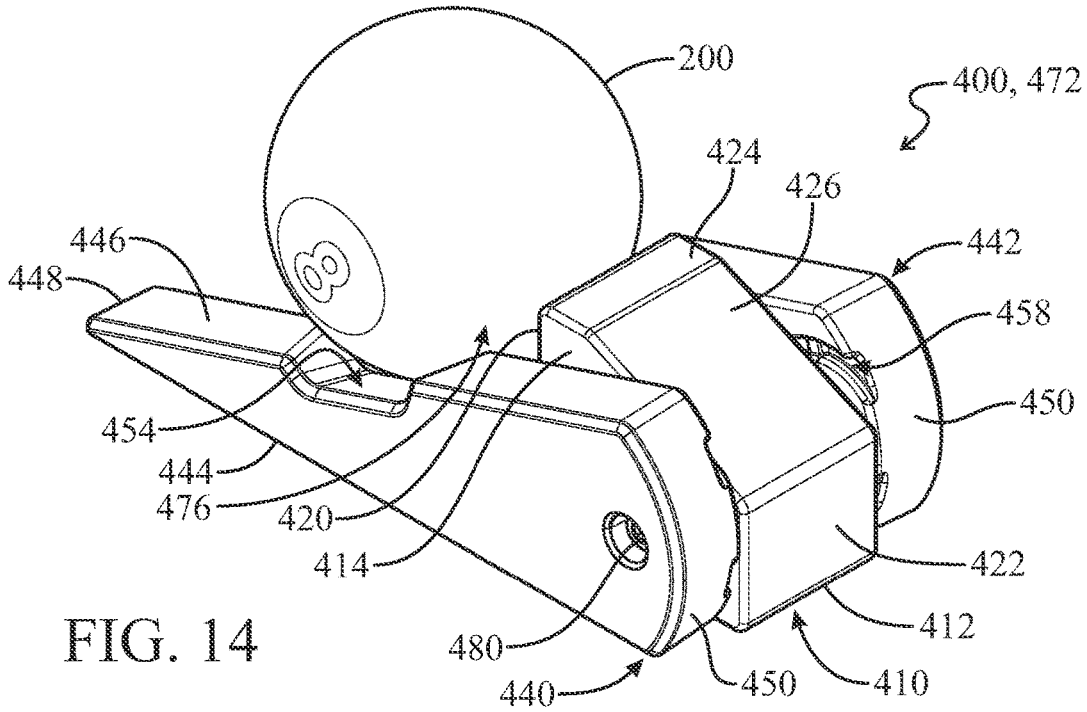
FIG. 14 is a perspective view of the training device of FIG. 8 in the second configuration with the object ball positioned in a second launch location in accordance with the present disclosure.

The pair of triangularly shaped ramps 440, 442 in combination with the central base 410 define a first configuration 470 (shown in FIGS. 8, 9, and 13) and a second configuration 472 (shown in FIGS. 10, 11, and 14). The pair of triangularly shaped ramps 440, 442 may rotate about the central base 410 between the first and second configurations 470, 472. At least a portion of the central base 410 may extend away from the pair of triangularly shaped ramps 440, 442, beyond the respective arcuate edges 450, in the first configuration 470. The central base 410 may be wholly encapsulated between the pair of triangularly shaped ramps 440, 442 in the second configuration 472. The second ramp edges 446 of the pair of triangularly shaped ramps 440, 442 may be positioned parallel to the rectangular bottom surface 412 of the central base 410 in the first configuration 470. The first ramp edges 444 of the pair of triangularly shaped ramps 440, 442 may be positioned parallel to the rectangular bottom surface 412 of the central base 410 in the second configuration 472.

The second ramp edges 446 of the pair of triangularly shaped ramps 440, 442 may each include a common length 452 and a receiver channel 454. The receiver channels 454 of the pair of triangularly shaped ramps 440, 442 may be defined perpendicularly to the common length 452 and may be aligned with each other relative to the common length 452. The receiver channels 454 may be defined centrally along the common length 452. In certain optional embodiments, the receiver channels 454 may be defined closer to or further from the corner 448. As illustrated, the receiver channels 454 are trapezoid shaped, more specifically, as isosceles trapezoids. In other optional embodiments, the receiver channels 454 may be shaped differently, for example, triangular, circular, rectangular, or the like.

As illustrated in FIG. 13, the arcuate edges 450 of the pair of triangularly shaped ramps 440, 442 in conjunction with the central base 410 define a first launch location 474 in the first configuration 470. As illustrated in FIG. 14, the receiver channels 454 defined along the second ramp edges 446 of the pair of triangularly shaped ramps 440, 442 define a second launch location 476 in the second configuration 472. The first and second launch locations 474, 476 are configured to the object ball 200. The object ball 200 may be rolled down the pair of triangularly shaped ramps 440, 442 via a user's hand (not shown) or by positioning a subsequent object ball (not shown) in the place of the object ball 200 to be launched. The object ball 200 as launched from the first launch location 474 may travel further than the object ball 200 as launched from the second launch location 476. By having two different launch locations, a user may easily launch balls to varying distances for practicing both near and far shots.

Figure 12:
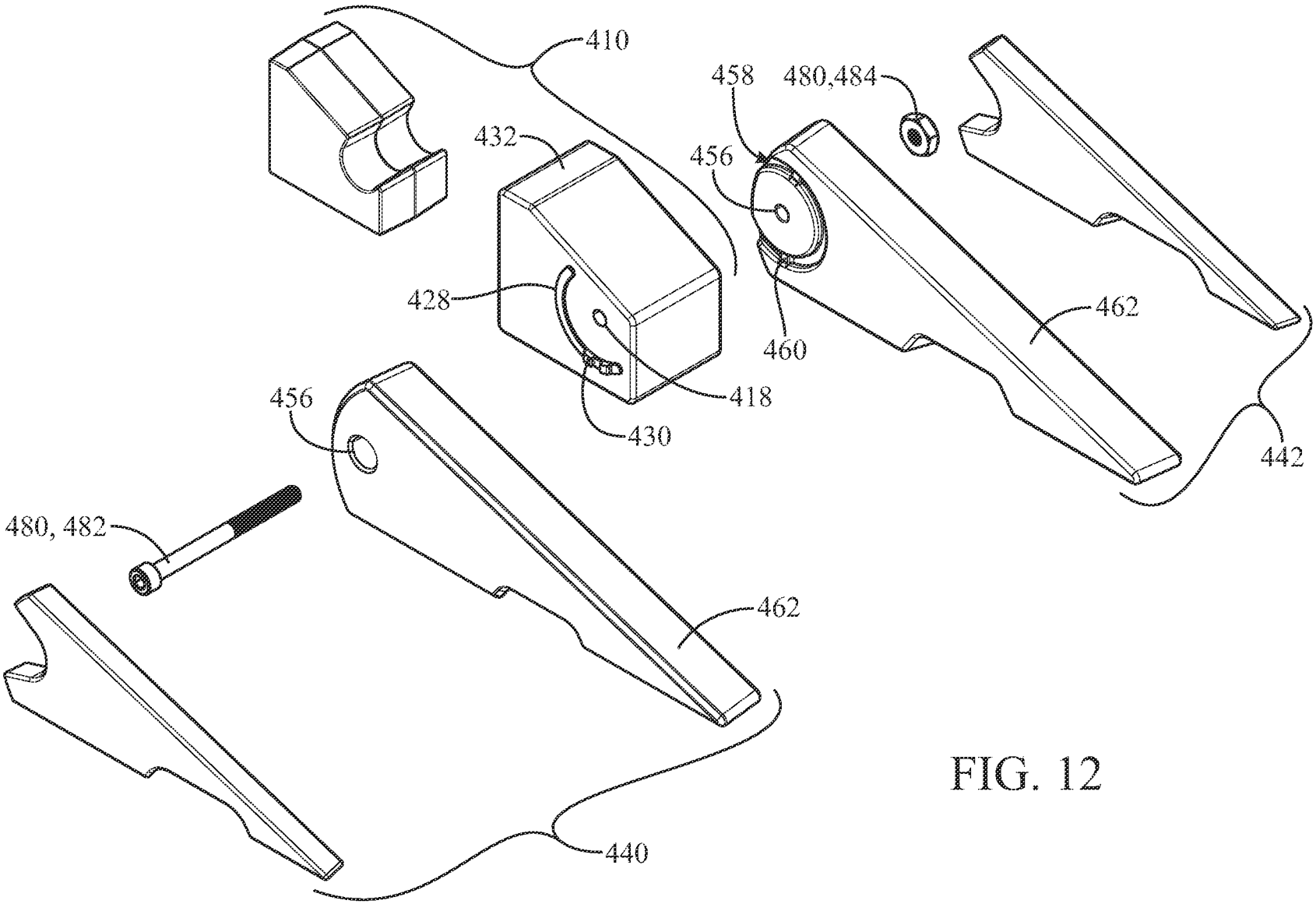
FIG. 12 is an exploded view of the training device of FIG. 8 in accordance with the present disclosure.

As illustrated in FIG. 12, the training device 400 is shown exploded. Each ramp of the pair of triangularly shaped ramps 440, 442 may include a ramp hole 456 positioned closer to the arcuate edge 450 than to the corner 448. The ramp hole 456 of each ramp of the pair of triangularly shaped ramps 440, 442 is configured to align with the hole 418 of the central base 410 and receive a fastener 480 for pivotally coupling the pair of triangularly shaped ramps 440, 442 to the central base 410. As illustrated, the fastener 480 may be a bolt 482 and a nut 484. In other embodiments, the fastener 480 may include screws, a lateral pin or rod that rotatably extends through designated fastener openings for enabling pivotal movement, or the like fasteners.

Each ramp of the pair of triangularly shaped ramps 440, 442 may include an elongated channel 458 facing the central body 410 defined circumferentially about the respective ramp hole 456. Each of the first and second pentagonal side walls 414, 416 of the central base 410 includes an elongated protrusion 428 defined circumferentially about the hole 418. The elongated protrusion 428 of the first pentagonal side wall 414 is configured to engage the elongated channel 458 of one ramp of the pair of triangularly shaped ramps 440, 442. The elongated protrusion 428 of the second pentagonal side wall 416 is configured to engage the elongated channel 458 of a different ramp of the pair of triangularly shaped ramps 440, 442.

The elongated channel 458 of each ramp of the pair of triangularly shaped ramps 440, 442 may include at least one movement limiting protrusion 460 defined therein. The elongated protrusions 428 of the first and second pentagonal side walls 414, 416 may include at least one movement limiting protrusion 430. The at least one movement limiting protrusion 430 may be configured to engage the at least one movement limiting protrusion 460 for limiting pivotal movement between the first and second configurations 470, 472 only.

As illustrated in FIG. 12, the central base 410 may include an external covering 432 and each ramp of the pair of triangularly shaped ramps 440, 442 may include an external covering 462. The external coverings 432, 462 may be rubber or any other the like non-slip material.

Figure 15:
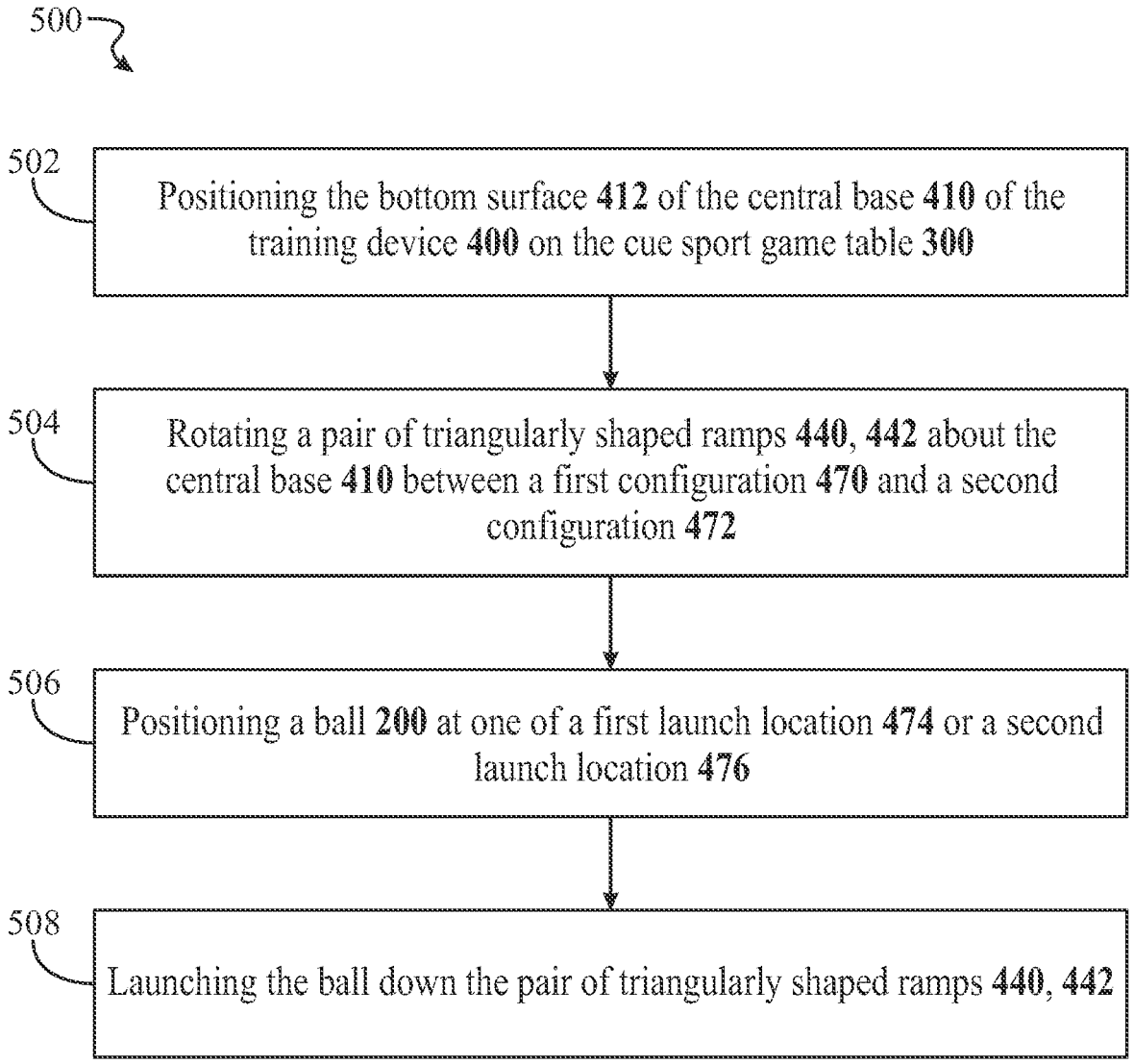
FIG. 15 is a flow chart of a method of positioning balls on a cue sport game table using the training device of FIG. 8 in accordance with the present disclosure.

Referring to FIG. 15, a method 500 of positioning balls on a cue sport game table using the training device 400. The method 500 comprises positioning 502 the bottom surface 412 of the central base 410 of the training device 400 on the cue sport game table 300. The method 500 further comprises rotating 504 a pair of triangularly shaped ramps 440, 442 about the central base 410 between a first configuration 470 and a second configuration 472. The method 500 further comprises positioning 506 a ball 200 at one of a first launch location 474 or a second launch location 476. The method 500 further comprises launching 508 the ball down the pair of triangularly shaped ramps 440, 442. The step of launching 508 may further include positioning a subsequent ball 202 in place of the ball 200 to be launched at the same one of the first launch location 474 or the second launch location 476. As mentioned previously, the first launch location 474 is associated with the first configuration 470 and the second launch location 476 is associated with the second configuration 472.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A training device for positioning balls on cue sport game tables, the training device comprising:

a central base including a rectangular bottom surface, first and second pentagonal side walls extending perpendicularly from the rectangular bottom surface, and a hole defined between the first and second pentagonal side walls; and a pair of triangularly shaped ramps rotatably coupled to the central base on opposite sides of the first and second pentagonal side walls, each ramp of the pair of triangularly shaped ramps includes first and second ramp edges extending acutely from a respective corner distal the central base, the pair of triangularly shaped ramps in combination with the central base defines at least a first configuration associated with a first launch location and a second configuration associated with a second launch location, the second ramp edges of the pair of triangularly shaped ramps positioned parallel to the rectangular bottom surface of the central base in the first configuration, the first ramp edges of the pair of triangularly shaped ramps positioned parallel to the rectangular bottom surface of the central base in the second configuration.

2. The training device of claim 1, wherein:

the first and second ramp edges of each ramp of the pair of triangularly shaped ramps are equal in length.

3. The training device of claim 1, wherein:

each ramp of the pair of triangularly shaped ramps includes an arcuate edge extending between the first and second ramp edges opposite the respective corner.

4. The training device of claim 3, wherein:

at least a portion of the central base extends away from the pair of triangularly shaped ramps beyond the respective arcuate edges in the first configuration.

5. The training device of claim 3, wherein:

the pair of triangularly shaped ramps are pivotally coupled to the central base closer to the arcuate edge than to the respective corner of each ramp of the pair of triangularly shaped ramps using a fastener extending through the hole of the central base.

6. The training device of claim 3, wherein:

the first launch location is defined between the arcuate edges of each of the pair of triangularly shaped ramps and the central base in the first configuration.

7. The training device of claim 1, wherein:

the first launch location is defined in the first configuration and the second launch location is defined in the second configuration; and the first and second launch locations are configured to receive a ball prior to rolling the ball down the pair of triangularly shaped ramps.

8. The training device of claim 1, wherein:

the second ramp edges of the pair of triangularly shaped ramps each include a common length and a receiver channel defined perpendicularly to the common length; and the receiver channel of the second ramp edges of the pair of triangularly shaped ramps define the second launch location in the second configuration.

9. The training device of claim 8, wherein:

the receiver channel of each of the second ramp edges of the pair of triangularly shaped ramps are trapezoid shaped.

10. The training device of claim 1, wherein:

the pair of triangularly shaped ramps pivot around the central base between the first and second configurations.

11. The training device of claim 1, wherein:

each of the central base and the pair of triangularly shaped ramps includes a external non-slip covering.

12. The training device of claim 1, wherein:

the first pentagonal side wall is parallel to and spaced apart from the second pentagonal side wall.

13. The training device of claim 1, wherein:

the central base includes a first surface extending perpendicularly from the rectangular bottom surface between the first and second pentagonal side walls;

the central base includes a second surface extending perpendicularly from the rectangular bottom surface opposite the first surface between the first and second pentagonal side walls;

the central base includes a third surface extending from the first surface parallel to the rectangular bottom surface between the first and second pentagonal side walls; and the central base includes a fourth surface angularly extending between the second surface and the third surface and defined between the first and second pentagonal side walls.

14. The training device of claim 1, wherein:

each ramp of the pair of triangularly shaped ramps includes an arcuate edge defined between the first and second ramp edges, and a ramp hole positioned closer to the arcuate edge than to the respective corner; and the ramp hole of each ramp of the pair of triangularly shaped ramps is configured to align with the hole of the central base and receive a fastener for pivotally coupling the pair of triangularly shaped ramps to the central base.

15. The training device of claim 14, wherein:

each ramp of the pair of triangularly shaped ramps includes an elongated channel facing the central body defined circumferentially about the respective ramp hole; and each of the first and second pentagonal side walls of the central base includes an elongated protrusion defined circumferentially about the hole.

16. The training device of claim 15, wherein:

the elongated protrusion of the first pentagonal side wall is configured to engage the elongated channel of one ramp of the pair of triangularly shaped ramps; and the elongated protrusion of the second pentagonal side wall is configured to engage the elongated channel of a different ramp of the pair of triangularly shaped ramps.

17. The training device of claim 16, wherein:

the elongated protrusions of the first and second pentagonal side walls of the central base includes at least one movement limiting protrusion extending therefrom;

the elongated channels of the pair of triangularly shaped ramps include at least one movement limiting protrusion positioned therein; and the at least one movement limiting protrusion of the elongated protrusion and the at least one movement limiting protrusion of the elongated channel are configured to selectively engage to limit movement between the first and second configurations.

* * * * *